US007198272B2

(12) United States Patent
Duhamel et al.

(10) Patent No.: US 7,198,272 B2
(45) Date of Patent: Apr. 3, 2007

(54) METHOD OF OFFERING INSURANCE IN A GAMBLING GAME

(75) Inventors: Gérald Duhamel, Drummondville (CA); Marie-Claude Gagnon, Drummondville (CA)

(73) Assignee: Labtronix Concept Inc., Drummondville, Quebec (CA)

( * ) Notice: Subject to any disclaimer, the term of this patent is extended or adjusted under 35 U.S.C. 154(b) by 397 days.

(21) Appl. No.: 10/686,533

(22) Filed: Oct. 16, 2003

(65) Prior Publication Data

US 2004/0130098 A1 Jul. 8, 2004

Related U.S. Application Data

(60) Provisional application No. 60/418,378, filed on Oct. 16, 2002.

(51) Int. Cl.
*A63F 1/00* (2006.01)

(52) U.S. Cl. ..... 273/292; 273/274

(58) Field of Classification Search ..... 273/292, 273/274, 309; 463/12, 13

See application file for complete search history.

(56) References Cited

U.S. PATENT DOCUMENTS

| | | | | | |
|---|---|---|---|---|---|
| 5,257,789 | A | * | 11/1993 | LeVasseur | 273/309 |
| 5,997,002 | A | * | 12/1999 | Goldman | 273/292 |
| 6,070,873 | A | | 6/2000 | Perkins | |
| 6,135,882 | A | | 10/2000 | Kadlic | |
| 6,146,271 | A | | 11/2000 | Kadlic | |
| 6,234,485 | B1 | | 5/2001 | Perkins | |
| 6,402,148 | B1 | * | 6/2002 | Saruwatari | 273/292 |
| 6,585,588 | B2 | * | 7/2003 | Hartl | 463/16 |

* cited by examiner

*Primary Examiner*—Benjamin Layno
(74) *Attorney, Agent, or Firm*—Ogilvy Renault LLP

(57) ABSTRACT

A method of playing a game of chance wherein at least one first wager and at least one second wager are placed by a player. In response to said first and second wagers, at least one first set of game indicia are distributed and evaluated according to a first set of game rules. If at least a predetermined number of said first set of game indicia result in a losing outcome, a second chance of winning is provided to the player in two different manners: a) distributing at least one second set of gaming indicia, which are evaluated according to a second set of game rules, said second set of game rules may be identical to the first set of game rules; or b) evaluating the at least one first set of game indicia by applying a third set of game rules.

21 Claims, 3 Drawing Sheets

METHOD OF OFFERING INSURANCE IN A GAMBLING GAME

RELATED APPLICATIONS

This application claims benefit of priority of U.S. Provisional Patent Application Ser. No. 60/418,378, filed on Oct. 16$^{th}$ 2002 and entitled METHOD OF OFFERING INSURANCE IN A GAMBLING GAME.

FIELD OF THE INVENTION

The present invention relates to an insurance feature offering a second chance to win to the player in a game of chance.

BACKGROUND OF THE INVENTION

In the recent years, numerous strategies to offer players better pay tables and higher chances to win have been developed. Blackjack already offers the player the possibility of buying insurance, but it is only offered in cases where the dealer has the possibility of getting a Blackjack, and protects the players only if the dealer's hand actually results in a Blackjack outcome.

Other patents teach us methods to offer a second chance to win to a player. U.S. Pat. Nos. 6,070,873 and 6,234,485 describe a game wherein the player is offered a chance, when he loses, to place a second bet, corresponding to half the value of his primary wager. Said second bet allows him to "buy" a sixth card, and thus gives him a chance of getting a better hand and increasing his chances to win. This does not allow to greatly change the chances to win since only adding one card does not nullified the effect of a useless primary hand.

Another patent family, among which U.S. Pat. Nos. 6,135,882 and 6,146,271, teach us a method in which the player is allowed to choose his hand among a plurality of hands. This method gives some control over the game to the player but does not give him a second chance to win when the player has chosen a losing hand.

Other card games offer the player the opportunity to place an auxiliary bet on the dealer having a better ranking hand. In these games, the player is awarded a prize if the dealer has a hand equal or higher to that of his own hand. But this kind of auxiliary bet is not really an insurance, but more like a second game in which the player bets on his chance of having a lower hand ranking than the dealer's, thus a Baccarat-like bet.

Consequently, it is desirable to offer players a new game method offering a real second chance of winning.

SUMMARY OF THE INVENTION

Accordingly, this invention describes a method of playing a game of chance wherein at least one first wager and at least one second wager are placed by a player. In response to said first and second wagers, at least one first set of game indicia are distributed and evaluated according to a first set of game rules. If at least a predetermined number of said first set of game indicia results in a losing outcome, a second chance to win is provided to the player.

The second chance to win may be provided to the player in two different manners. First by distributing at least one second set of gaming indicia, which are evaluated according to a second set of game rules, said second set of game rules may be identical to the first set of game rules. The second way of providing said second chance to win is to evaluate at least one of the first set of game indicia by applying a third set of game rules, different from the first set of game rules.

BRIEF DESCRIPTIONS OF THE DRAWINGS

These and other aspects and advantages of the present invention will become better understood in light of the following detailed description of preferred embodiments with reference to the accompanying drawings, in which.

DETAILED DESCRIPTION OF THE PREFERRED EMBODIMENTS

Figure 1:
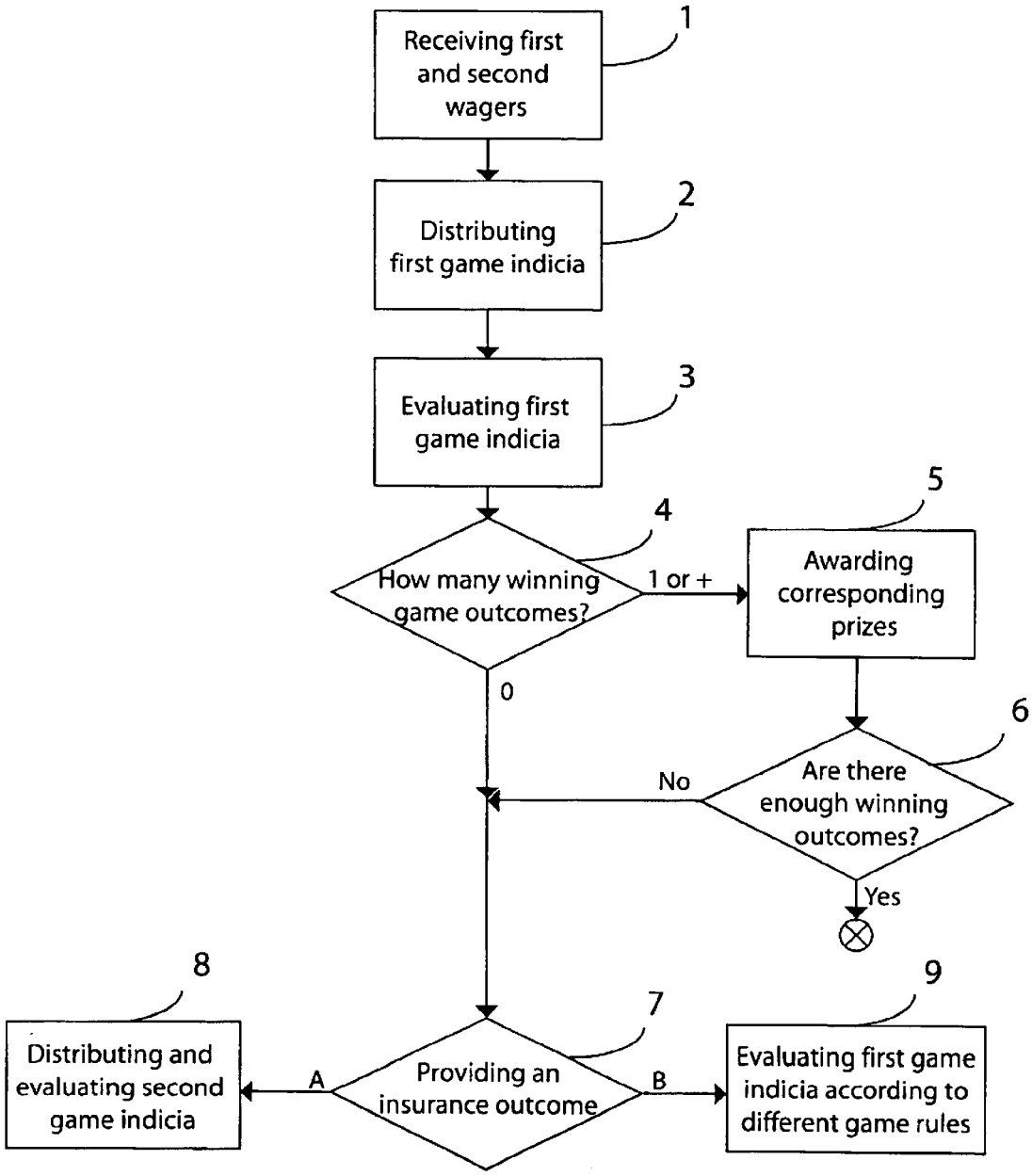
FIG. 1 is a flowchart describing the method of playing a game of chance of the current invention.

The present invention describes a game of chance wherein the player is offered a second chance in the case of a determined losing game outcome. Accordingly, FIG. 1 illustrates the process of the game to provide this second chance as an insurance outcome. After the player has placed his first and second wagers 1, which can be combined in a unique or global bet, at least one first set of game indicia is distributed 2. Each first set of game indicia is evaluated 3 and it is determined whether a winning first game outcome results from said first set of game indicia. It is determined how many winning first game outcomes result from the evaluation of at least one first set of game indicia 4. If at least one winning first outcome is present, the corresponding prize is awarded for each of said winning first outcomes 5. It is then determined whether the number of winning first outcomes reaches the predetermined threshold or not 6. If there were not enough winning first outcomes or there were none, an insurance outcome is provided 7 in one of two ways: a) distributing and evaluating according to identical or different game rules at least one second set of game indicia 8 and b) evaluating the at least one first set of game indicia according to different game rules 9. If there were only one first set of game indicia, an insurance outcome is not provided when said first set of game indicia results in a winning first game outcome.

This invention may be applied to any gambling game such as line games, blackjack, bingo, lotto and keno, and thus the following descriptions must not be construed as limitations to the present invention.

EXAMPLE 1

Stud Poker

Figure 2:
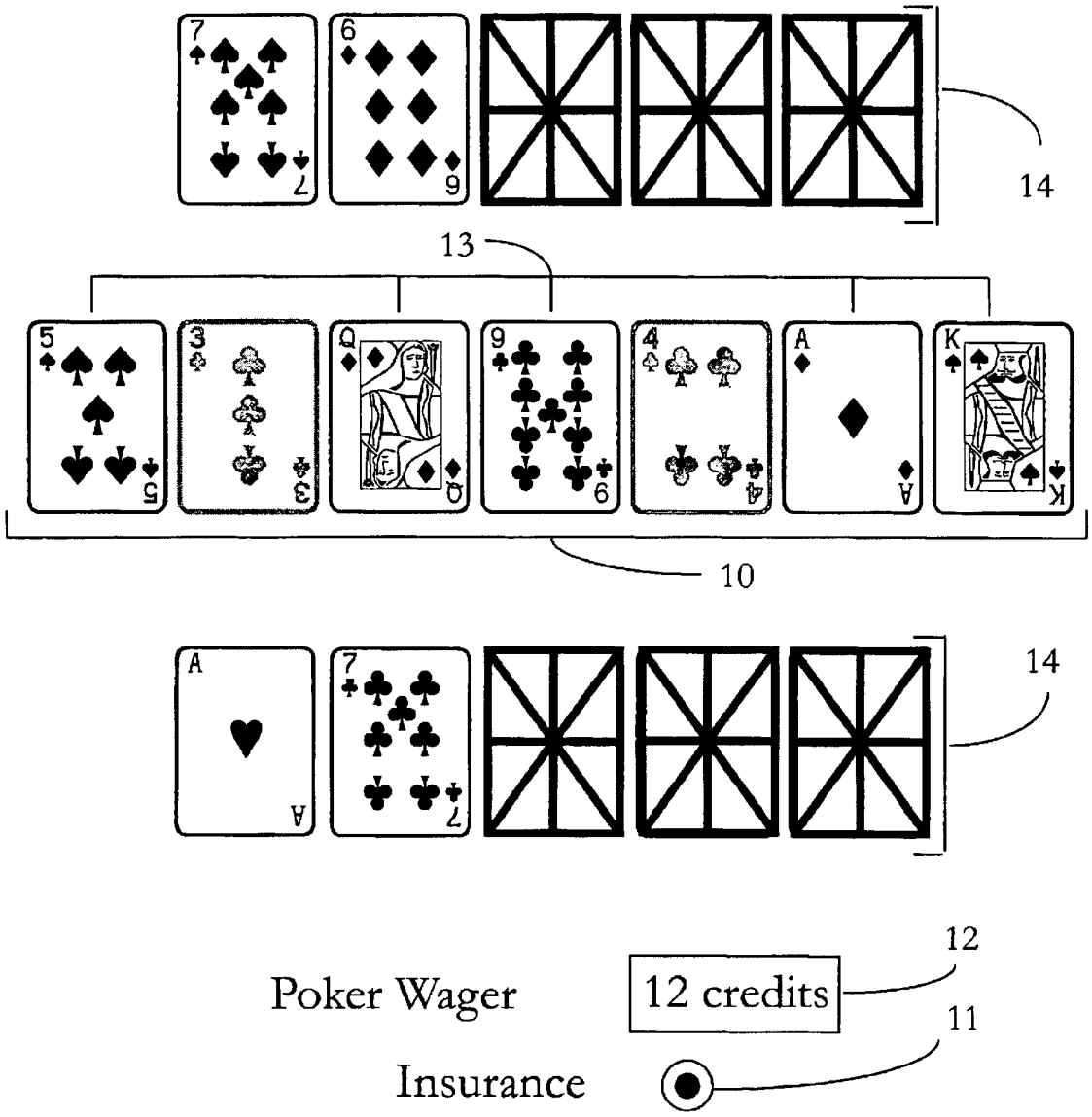
FIG. 2 represents stud poker game offering an insurance feature by dealing two insurance hands.

A player places a bet comprising an insurance option, and is dealt a seven-card primary hand, as well as two (2) partially concealed five-card poker hands. FIG. 2 illustrates this game. The game hand 10, on which the player has placed a wager of twelve (12) credits 12 including an insurance option 11, comprises the following cards: Five and King of Spades; Three, Four and Nine of Clubs; and Ace and Queen of Diamonds. The player chooses five (5) of these seven (7) cards (the non-chosen cards are displayed in grey) to form his first game outcome 13. Since said first game outcome is determined as a losing outcome according to a first set of game rules, in this example standard stud poker ranking rules, the player selects one of the two insurance five-card hands 14, based on the information of the non-concealed cards. The second set of game rules which apply to the insurance outcome is those of a draw poker and thus, the player plays the selected hand to its completion, including selecting cards to hold, discarding the others and receiving new cards to complete the hand. The insurance hand is evaluated according to standard poker ranking rules and the player receives a prize for a winning hand, based on said standard poker ranking rules, the applied pay table, which can be the same as used in the first game, and on the placed bet.

EXAMPLE 2

Blackjack

A player places a first and second wager, the second wager providing an insurance option. The player receives a first blackjack hand and plays it to its completion, thus to the determination of a first game outcome according to a first set of game rules, namely standard blackjack game rules. If said first game outcome is determined as a losing outcome, the player receives a second hand which is evaluated according to a second set of game rules, here also blackjack. The player plays this second hand to its completion and an insurance outcome is determined according to the same standard blackjack game rules. If the insurance outcome is a winning outcome, the player receives a prize based on a standard blackjack pay table and on the second wager value. It is to be noted that if the first game outcome had been determined as a winning outcome, the prize awarded to the player would have been based on the standard blackjack pay table and on the first wager value.

EXAMPLE 3

Draw Poker

A player places up to three first wagers and one second wager, the second wager providing an insurance option. The player receives a five-card hand for each of placed first wager.

Figure 3:
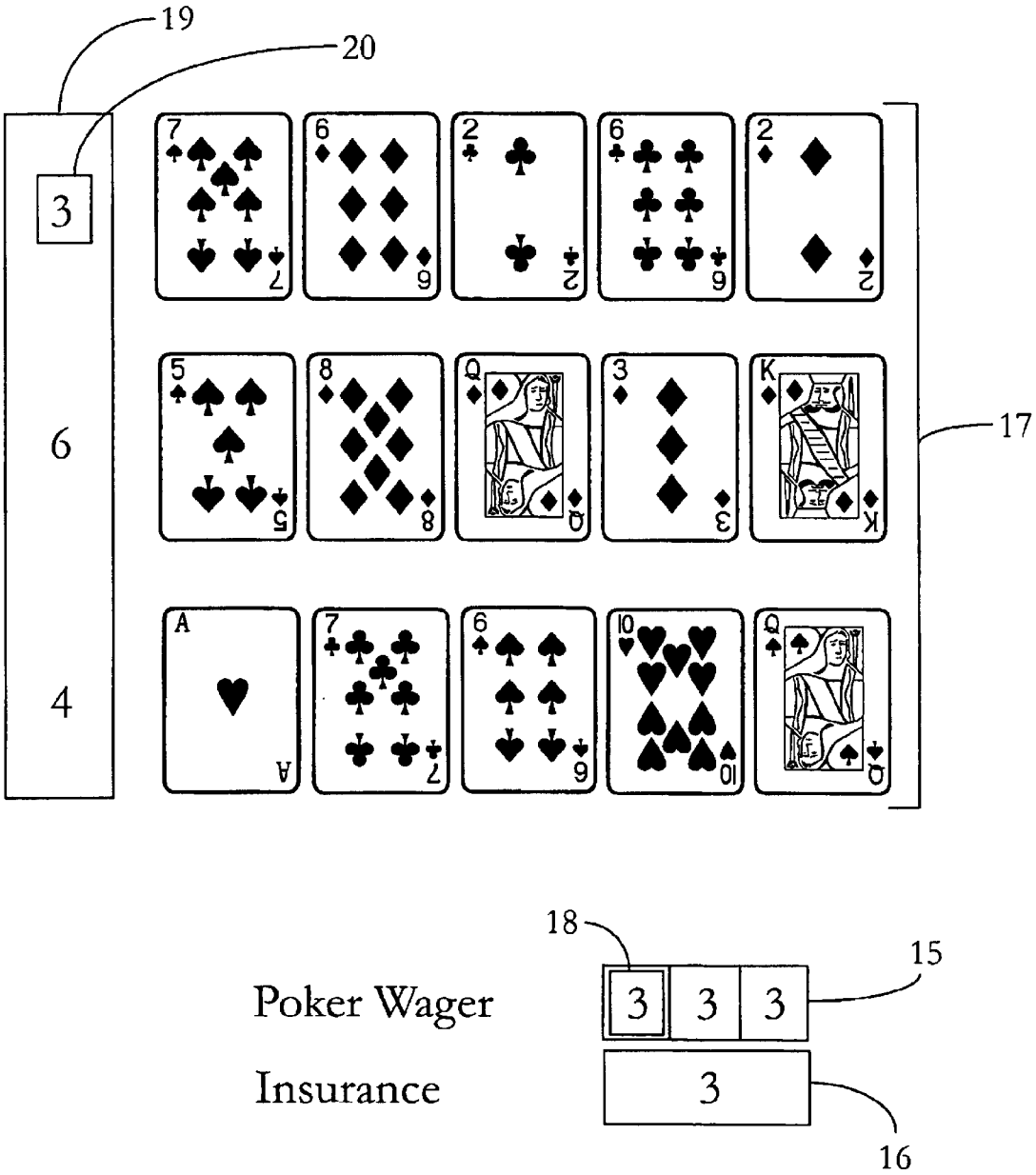
FIG. 3 represents a draw poker game offering an insurance feature by applying an insurance pay table.

FIG. 3 illustrates an example wherein the player placed three (3) first wagers 15 and an insurance wager 16. He is distributed three (3) five-card hands 17, which are played according to a first set of game rules, in this example draw poker rules, to their completion. Each hand is analyzed to determine first game outcomes. A prize is awarded to the player for each winning hand, based on a standard draw poker pay table and the first wager placed on this hand 18. Since two of said hands correspond to losing outcomes, the player is provided with an insurance outcome. The winning hand is used as a comparison hand and the three hands are evaluated according to a third set of game rules, here baccarat rules. To apply these rules, the cards of each hand are summed in the following way: the cards from Aces to Nines have values ranging from one (1) to nine (9) according to their face value and Tens, Jacks, Queens and Kings have a value of zero (0) and then keeping only the last digit 19. The player receives a prize, based on the first wager placed on this hand, for each hand that has a value closer to nine (9) than that of the Comparison hand. In our example, the player is awarded a prize for both his baccarat hands since both have baccarat outcomes (six [6] and four [4]) closer to nine (9) than the comparison hand baccarat outcome (three [3]) 20. In the case of three (3) losing player's hands, one hand is randomly selected to be used as Comparison hand to complete the game.

EXAMPLE 4

Lotto 4

The player places a first and second wager, the second wager comprising an insurance option. The player selects his card of four (4) digits and a winning combination is drawn. The player's card is compared to the winning combination and a first game outcome is determined according to a first set of game rules. If the card is determined as a losing card, an insurance pay table, comprised in a third set of game rules, is applied to said card by comparing the drawn numbers to the selected numbers, regardless of their positions. If the number of matching numbers reaches a predetermined threshold, with or without repetition, the player is awarded a prize, based on the second wager.

EXAMPLE 5

Line Game

The player places at least one first and at least one second wager, the at least one second wager comprising an insurance option. The reels of the line game spin and stop to generate a first game outcome. The lines on which the player has placed a wager are analyzed according to a first set of game rules to determine if said first game outcome is a winning or a losing outcome, wherein a winning outcome comprises at least one winning line. If the first game outcome were determined as a losing outcome, the player selects lines, among said played lines, in a number corresponding to the number of placed second wagers. Each of the selected lines is played, according to a second set of game rules, as a draw poker game in which the player selects symbols to hold and thus reels to re-spin. The final insurance outcome of each line is analyzed and a prize value is determined for each winning insurance outcome, based on the sum of the first and the second wagers placed on this line. The player is awarded the highest of the prize values.

EXAMPLE 6

Stud Poker

The player places a first wager and is dealt a stud poker five-card hand, of which three (3) cards are dealt face down. The player determines his chances of winning and is offered a chance to place a second wager, comprising an insurance option. If the player decides to place said second wager, five (5) five-card insurance hands are dealt face down. The hidden cards of the first hand are revealed and the hand is evaluated according to standard stud poker rules (first set of game rules). If the first game outcome were determined as a losing outcome, the first card of the five (5) insurance hands is revealed and compared to the first card of the first game hand. All of the insurance hands fulfilling criteria, here having a first card of the same color as the first card of the first game hand, will be used to provide insurance outcomes and the others are removed. The played insurance hands are revealed and evaluated according to a second set of game rules, in this example the same standard stud poker rules as the first game outcome to determine insurance outcomes. The player is awarded the prizes corresponding to two (2) of said insurance outcomes. If more than two of said played insurance hands result in a winning outcome, two are randomly selected and their prize values, based on the second wager, are awarded to the player. If only one of said played insurance hands results in a winning outcome, the player is awarded the corresponding prize, based on the second wager.

EXAMPLE 7

Line Game

The player places at least one wager, one for each line the player desires to bet on, and said wager comprising an insurance option for each played lines. The reels are spun and a first game outcome is generated and evaluated according to a pay table awarding prizes for winning lines read from left to right (first set of game rules). If all played lines were determined as losing outcomes, the lines are re-evaluated according to the same pay table but read from right to left (third set of game rules) to determine insurance outcomes. All the winning insurance outcomes corresponding prizes are awarded to the player, each prize being based on the wager placed on this line.

Accordingly, while the invention has been described in connection with the specific embodiments thereof, it will be understood that modifications are available. It is the intent to cover any variations, uses or adaptations of the invention following, in general, the principles of the invention. Such covered applications will find their essential features herein in the scope of the appended claims.

We claim:

1. A method of playing a game of chance comprising:

receiving at least one first wager from a player;

receiving at least one second wager from a player;

distributing at least one first set of game indicia;

evaluating said at least one first set of game indicia according to a first set of game rules to determine at least one first game outcome; and determining whether the at least one first game outcome is a losing outcome; determining a number of losing outcome(s) among said at least one first game outcome; and if said number of losing outcome(s) corresponds to a predetermined number of losing first game outcomes, providing at least one insurance outcome by doing one of a) distributing at least one second set of game indicia and evaluating said at least one second set of game indicia according to a second set of game rules and b) evaluating said at least one first set of game indicia according to at least one third set of game rules.

2. The method of claim 1 comprises receiving the at least one first wager and the at least one second wager as a global bet.

3. The method of claim 1 wherein the insurance outcome is provided according to a), the step of evaluating said at least one second set of game indicia comprising conducting the game to its completion according to said second set of game rules.

4. The method of claim 1 wherein the insurance outcome is provided according to b), the step of evaluating said at least one first set of game indicia comprising conducting the game to its completion according to said third set of game rules.

5. The method of claim 1 comprises awarding at least one prize according to the first set of game rules to the player if at least one of the at least one first game outcome were determined as a winning outcome.

6. The method of claim 1 wherein the step of distributing at least one second set of game indicia is characterized in that the number of second set of game indicia is based on the at least one second wager, either according to the number of wagers or their values.

7. The method of claim 1 wherein the step of distributing at least one second set of game indicia comprises displaying said at least one second set of game indicia at least partly concealed.

8. The method of claim 1 characterized in that at least one of the at least one first set of game indicia is selected, using one of a) receiving a player's selection, b) randomly selecting, or c) selecting according to criteria.

9. The method of claim 1 wherein the second set of game rules is identical to the first set of game rules.

10. The method of claim 1 wherein the third set of game rules is characteristic of a game type different than said game of chance.

11. The method of claim 1 comprises determining whether the at least one insurance outcome is a winning outcome.

12. The method of claim 1 comprises awarding at least one prize for each winning insurance outcome.

13. The method of claim 12 wherein the prize awarded for a winning insurance outcome is based on the at least one second wager.

14. The method of claim 1 comprises selecting at least one of the at least one second set of game indicia using one of a) randomly selecting, b) selecting according to criteria, and c) receiving a player's selection.

15. The method of claim 14 comprises awarding at least one prize for each selected set game indicia determined as a winning insurance outcome.

16. The method of claim 15 wherein the prize awarded for a winning insurance outcome is based on the at least one second wager.

17. The method of claim 14 comprises selecting at least one of the selected sets of game indicia determined as winning insurance outcomes using one of a) randomly selecting and b) selecting according to criteria.

18. The method of claim 17 comprises awarding at least one prize for each selected winning insurance outcome.

19. The method of claim 18 wherein the prize awarded for a winning insurance outcome is based on the at least one second wager.

20. The method of claim 1 wherein the game indicia are at least one of dice, cards, symbols, numbers, and tiles.

21. The method of claim 1 characterized in that the steps are executed in the order described in said claim 1.

* * * * *